US006722487B1

(12) United States Patent
Bell

(10) Patent No.: US 6,722,487 B1
(45) Date of Patent: Apr. 20, 2004

(54) MONEY ITEM ACCEPTOR

(75) Inventor: Malcolm Reginald Hallas Bell, Leeds (GB)

(73) Assignee: Coin Controls Limited (GB)

( * ) Notice: Subject to any disclaimer, the term of this patent is extended or adjusted under 35 U.S.C. 154(b) by 0 days.

(21) Appl. No.: 09/913,031

(22) PCT Filed: Feb. 4, 2000

(86) PCT No.: PCT/GB00/00339

§ 371 (c)(1),
(2), (4) Date: Dec. 11, 2001

(87) PCT Pub. No.: WO00/48138

PCT Pub. Date: Aug. 17, 2000

(30) Foreign Application Priority Data

Feb. 10, 1999 (GB) ..... 9903024

(51) Int. Cl.[7] ..... G07D 5/00
(52) U.S. Cl. ..... 194/302
(58) Field of Search ..... 194/317, 318, 194/305, 306, 307, 310, 302, 212, 206, 207

(56) References Cited

U.S. PATENT DOCUMENTS

| | | | | |
|---|---|---|---|---|
| 4,546,869 A | | 10/1985 | Dean et al. | 194/99 |
| 4,864,238 A | | 9/1989 | Seitz | 324/253 |
| 5,355,989 A | * | 10/1994 | Best | 194/317 |
| 5,564,548 A | * | 10/1996 | Dobbins et al. | 194/317 |
| 5,718,318 A | | 2/1998 | Wachter | 194/206 |
| 5,730,272 A | * | 3/1998 | Dobbins et al. | 194/317 |

FOREIGN PATENT DOCUMENTS

| | | | |
|---|---|---|---|
| EP | 0.328.441 A2 * | 8/1989 | G07F/3/02 |
| EP | 0 384 375 | 8/1990 | G07F/3/02 |
| GB | 2 169 429 A | 7/1986 | |
| WO | 96/35022 | 11/1996 | G07F/3/02 |

* cited by examiner

*Primary Examiner*—Donald P. Walsh
*Assistant Examiner*—Mark J. Beauchaine
(74) *Attorney, Agent, or Firm*—Morgan & Finnegan, LLP

(57) ABSTRACT

An acceptor for money items such as coins or banknotes produces a money item parameter signal $x_1$ as a function of a sensed characteristic of a money item. A store (12) provides data which defines a window corresponding to a normal acceptance range of values of the parameter signal for a money item of a particular denomination (NAW), the range including relatively high and low acceptance probability regions (RAW, USM) which correspond to a relatively high or low probability or an occurrence of a sensed money item of a particular denomination. The processor (11) determines when an occurrence of the parameter signal $x_1$ falls within the low probability region (USM) and then for the next sensed money item compares the value of the parameter signal ($x_1$) with window data corresponding to a restricted acceptance range (RAW) so as only to accept the second money item if the corresponding value of the parameter signal $x_1$ falls within the restricted acceptance range.

33 Claims, 3 Drawing Sheets

MONEY ITEM ACCEPTOR

FIELD OF THE INVENTION

This invention relates to an acceptor for money items such as coins and banknotes and has particular but not exclusive application to a multi-denomination acceptor.

BACKGROUND

Coin and banknote acceptors are well known. One example of a coin acceptor is described in our GB-A-2 169 429. The acceptor includes a coin rundown path along which coins pass through a coin sensing station at which sensor coils perform a series of inductive tests on the coins in order to develop coin parameter signals which are indicative of the material and metallic content of the coin under test. The coin parameter signals are digitised and compared with stored coin data by means of a microcontroller to determine the acceptability or otherwise of the test coin. If the coin is found to be acceptable, the microcontroller operates an accept gate so that the coin is directed to an accept path. Otherwise, the accept gate remains inoperative and the coin is directed to a reject path.

In banknote validators, sensors detect characteristics of the banknote. For example, optical detectors can be used to detect the geometrical size of the banknote, its spectral response to a light source in transmission or reflection, or the presence of magnetic printing ink can be detected with an appropriate sensor. The parameter signals thus developed are digitised and compared with stored values in a similar way to the previously described prior art coin acceptor. The acceptability of the banknote is determined on the basis of the results of the comparison.

When a number of coins or banknotes of the same denomination are passed through an acceptor, successive values of coin parameter data are thus developed. When the distribution of the values of these signals are plotted as a graph, the result is a bell curve, with a central peak and tails on opposite sides. The shape of the graph may typically although not necessarily be Gaussian.

The distribution illustrates that for a money item, such as a coin or banknote of a particular denomination, the most probable value of the corresponding parameter signal lies at the peak of the bell curve, with a decreasing probability to either side. In prior coin and banknote validators, data is stored in a memory, corresponding to acceptable ranges of parameter signal for a particular denomination. The acceptor thus compares the value for a coin or banknote under test with the stored data to determine authenticity. The data may define windows in terms of upper and lower limit values, or as a mean value and a standard deviation, such that the window comprises a predetermined number of standard deviations about the mean. By making the stored windows narrow, an increased discrimination is provided between true money items and frauds. However, if the windows are made too narrow, the rejection rate of true money items increases, disadvantageously. The width of the windows is thus selected as a compromise between these two factors. Attempts to defraud coin or banknote validators typically involve the manufacture of facsimile coins or banknotes which cause the accept to produce parameter signals which lie within the stored acceptance windows.

In U.S. Pat. No. 5,355,989, a coin acceptor is described which switches from using a first normal acceptance window for a true coin, to a second narrower window when a coin parameter signal produced by testing a coin, falls in a region of the normal window for the true coin, corresponding to a low acceptance probability region for the coin concerned. A group of fraudulent coins may all have similar characteristics and they may cause the validator to produce to produce parameter signals which lie within the normal window, but the parameter signals consistently have a value which is not centered on the high probability peak region of the window associated with the true coin but instead are centered on the lower probability tail regions of the bell curve distribution within the normal window. When the parameter signal falls within this low probability region, the second narrower window is then used for the next tested coin. If the next coin has a parameter falling in the narrower window it is a true coin but if not, it is a fraud which should be rejected. This approach seeks to prevent frauds carried out by the use of coins of a particular low value denomination, from a foreign currency set, with characteristics that correspond but are not exactly the same as a high value coin of the currency set that the acceptor is designed to accept. It will be understood that the foreign denomination coins exhibit their own generally Gaussian distribution of parameter signals, and if the low probability or tail region of this distribution partially overlaps a corresponding region of the distribution for the true coin that the acceptor is designed to accept, then the low value foreign coins will sometimes be accepted as true coins. However, significant problems remain. In the arrangement disclosed in U.S. Pat. No. 5,355,989, when a true coin is inserted, the system switches back from the second narrower window to the first normal acceptance window.

If the next coin inserted is a foreign currency coin, if it has a parameter signal within the normal acceptance window, it will be accepted although the system will then switch to the second narrower window for the next coin under test. If the next coin tested is a true coin, it will be accepted and the system will switch back to the first window. U.S. Pat. No. 5,355,989 considers the possibility of counting groups of n coins before making the switch between the windows. Thus, with the prior system, it is possible to obtain acceptance of a significant number of foreign currency coins by alternating them with true coins either individually or in equal numbered groups of n coins. A further disadvantage is that the system is very slow because the foreign coins do not all produce an acceptance and so when a fraudster is attempting to use foreign coins they may be rejected a number of times of falling outside of the first relatively wide acceptance window. However, the prior validator takes no account of the fraud attempt and will only respond when a fraudulent coin is in fact accepted.

SUMMARY OF THE INVENTION

The present invention seeks to overcome these problems. In accordance with the invention from a first aspect there is provided a money item acceptor comprising: a signal source to produce a money item parameter signal as a function of a sensed characteristic of a money item, a store to provide data corresponding to a normal acceptance range of values of the parameter signal for a money item of a particular denomination, the range including relatively high and low acceptance probability regions wherein the value of a parameter signal corresponds to a relatively high or low probability of an occurrence of sensed money item of said particular denomination, and a processor to determine when an occurrence of the parameter signal corresponding to a first money item adopts a predetermined value relationship, and in response thereto, to compare the value of a subsequent occurrence of the parameter signal corresponding to a second money item with data corresponding to a restricted acceptance range as compared with the normal acceptance range, and to provide an output corresponding to acceptability of the second money item if the second occurrence of the parameter signal falls within restricted acceptance range, wherein said predetermined value relationship occurs when the parameter signal corresponding to the first money item has a value within a predetermined security barrier range outside of the normal acceptance range.

In accordance with the invention, the predetermined security barrier range can be generally aligned with the peak of the distribution for the fraudulent coin so that even if the fraudulent coin produces a parameter signal outside of the normal acceptance range, the existence of the fraud attempt is detected and the acceptor switches to the restricted acceptance range to reduce the risk of fraud.

The invention further includes a corresponding method of detecting fraudulent coins.

In a second aspect, the invention provides a money item acceptor comprising: a signal source to produce a money item parameter signal as a function of a sensed characteristic of a money item, a store to provide data corresponding to a normal acceptance range of values of the parameter signal for a money item of a particular denomination, the range including relatively high and low acceptance probability regions wherein the value of a parameter signal corresponds to a relatively high or low probability of an occurrence of sensed money item of said particular denomination, and a processor to determine when an occurrence of the parameter signal corresponding to a first money item adopts a predetermined value relationship with the low acceptance probability region, and in response thereto, to compare the value of a subsequent occurrence of the parameter signal corresponding to a second money item with data corresponding to a restricted acceptance range as compared with the normal acceptance range, and to provide an output corresponding to acceptability of the second money item if the second occurrence of the parameter signal falls in the restricted acceptance range, said processor being operable to compare a first predetermined number of subsequent occurrences of the parameter signal with the restricted acceptance range, and if all of them correspond to acceptable money items, to revert to the normal acceptance range, wherein when using the normal range, the restricted acceptance range is selected in response to a second pre-selected number of occurrences of the parameter signal, smaller than said first predetermined number, adopting said predetermined value relationship.

By making the second pre-selected number smaller than the first pre-determined number, the discrimination against fraudulent coins is substantially improved. For example, only a single occurrence of a potentially fraudulent coin can trigger use of the restricted acceptance range and then, a larger number of occurrences of true coins falling within the restricted acceptance range need to occur before switching back to the normal acceptance range. Thus, if the fraudster repeatedly attempts to defraud the acceptor with fraudulent coins, each such attempt may trigger the use of the restricted acceptance range which is then used for a number of times so as to block subsequent fraud attempts. The acceptor is however responsive to each new fraud attempt thereby reducing the risk of acceptance of further fraudulent coins.

The processor may be operable to compare a predetermined number of subsequent occurrences of the parameter of the parameter signal with said restricted acceptance range, and if said predetermined number all correspond to acceptable money items, thereafter, to revert to the normal acceptance range.

The processor may further operate to compare any subsequent occurrences of the parameter signal with said restricted acceptance range for a predetermined time and then to revert to the normal acceptance range.

The signal source may be operable to produce a plurality of individual money item parameter signals each as a function of a respective different characteristic of a sensed money item, and the store may be configured to provide window data for normal acceptance ranges of values of the parameter signals individually for a money item of a particular denomination.

The processor may be operative to compare the first occurrence of each parameter signal individually with a corresponding one of said normal acceptance ranges, and to compare a subsequent occurrence of each of the different parameter signals with a corresponding restricted acceptance range for each parameter signal, in response to any one of the first occurrences of the parameter signals having a predetermined value relationship with the low acceptance probability region of its corresponding normal acceptance range.

Alternatively, the processor may be operative to compare the first occurrence of each parameter signal individually with a corresponding one of said normal acceptance ranges, and to compare a subsequent occurrence of each of the different parameter signals with a corresponding restricted acceptance range for each parameter signal selectively in response to the corresponding one of the first occurrences of the parameter signals having a predetermined value relationship with the low acceptance probability region of its normal acceptance range.

The acceptor according to the invention may be configured for use with coins, banknotes or other money items.

BRIEF DESCRIPTION OF THE DRAWINGS

In order that the invention may be more fully understood an embodiment thereof will now be described by way of example with reference to the accompanying drawings in which.

DETAILED DESCRIPTION

Overview of Coin Acceptor

Figure 1:
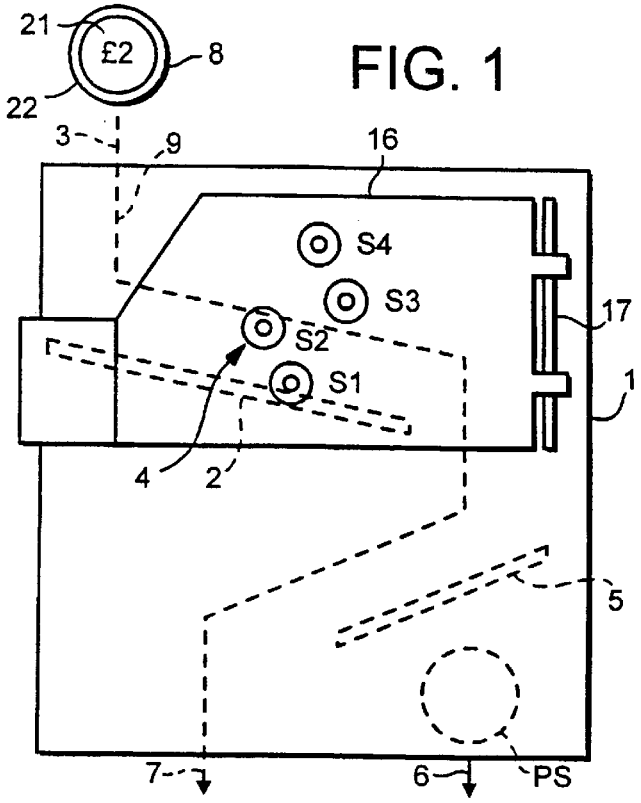
FIG. 1 is a schematic block diagram of a coin acceptor in accordance with the invention.

FIG. 1 illustrates the general configuration of an acceptor according to the invention for use with coins. The coin acceptor is capable of validating a number of coins of different denominations, including bimet coins, for example the new euro coin set and the new UK coin set including the new bimet £2.00 coin. The acceptor includes a body 1 with a coin run-down path 2 along which coins under test pass edgewise from an inlet 3 through a coin sensing station 4 and then fall towards a gate 5. A test is performed on each coin as it passes through the sensing station 4. If the outcome of the test indicates the presence of a true coin, the gate 5 is opened so that the coin can pass to an accept path 6, but otherwise the gate remains closed and the coin is deflected to a reject path 7. The coin path through the acceptor for a coin 8 is shown schematically by dotted line 9.

The coin sensing station 4 includes four coin sensing coil units S1, S2, S3 and S4 shown in dotted outline, which are energised in order to produce an inductive coupling with the coin. Also, a coil unit PS is provided in the accept path 6, downstream of the gate 5, to act as a credit sensor in order to detect whether a coin that was determined to be acceptable, has in fact passed into the accept path 6.

Figure 2:
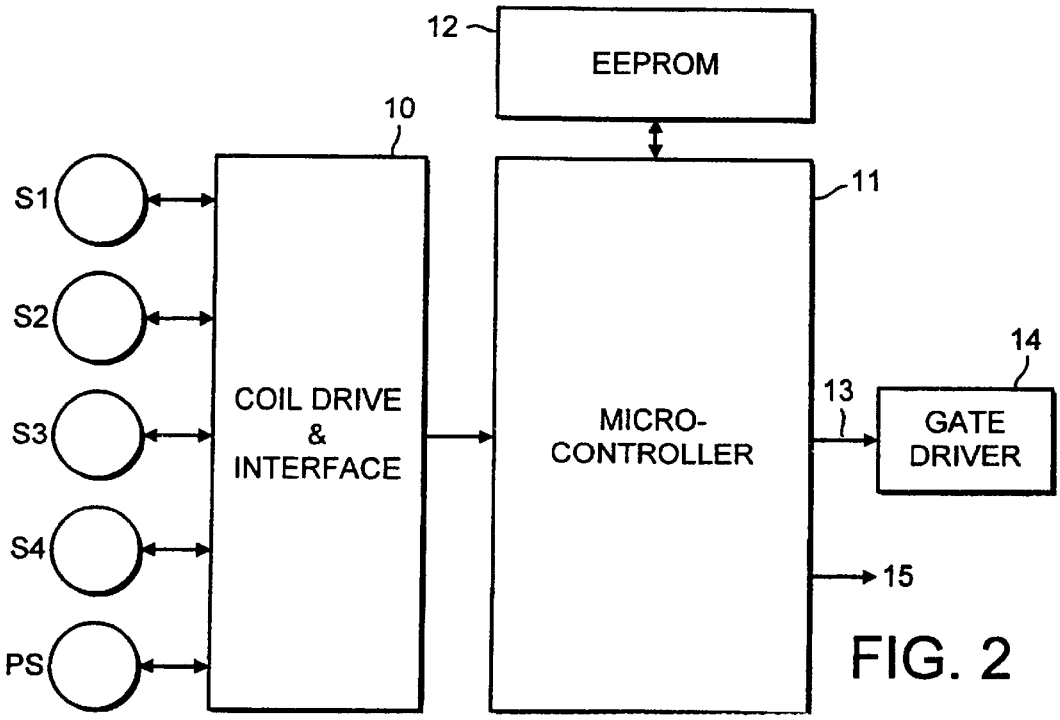
FIG. 2 is a schematic block diagram of the circuits of the acceptor shown in FIG. 1.

The coils are energised at different frequencies by a drive and interface circuit 10 shown schematically in FIG. 2. Eddy currents are induced in the coin under test by the coil units. The different inductive couplings between the four coils and the coin characterise the coin substantially uniquely. The drive and interface circuit 10 produces corresponding digital coin parameter data signals $x_1$, $x_2$, $x_3$, $x_4$, as a function of the different inductive couplings between the coin and the coil units S1, S2, S3 and S4. A corresponding signal is produced for the coil unit PS. The coils S have a small diameter in relation to the diameter of coins under test in order to detect the inductive characteristics of individual chordal regions of the coin. Improved discrimination can be achieved by making the area A of the coil unit S which faces the coin, such as the coil S1, smaller than 72 $mm^2$, which permits the inductive characteristics of individual regions of the coin's face to be sensed.

In order to determine coin authenticity, the coin parameter signals produced by a coin under test are fed to a microcontroller 11 which is coupled to a memory in the form of an EEPROM 12. The microcontroller 11 processes the coin parameter signals $x_1$–$x_4$ derived from the coin under test and compares the outcome with corresponding stored values held in the EEPROM 12. The stored values are held in terms of windows having upper and lower value limits. Thus, if the processed data falls within the corresponding windows associated with a true coin of a particular denomination, the coin is indicated to be acceptable, but otherwise is rejected. If acceptable, a signal is provided on line 13 to a drive circuit 14 which operates the gate 5 shown in FIG. 1 so as to allow the coin to pass to the accept path 6. Otherwise, the gate 5 is not opened and the coin passes to reject path 7.

The microcontroller 11 compares the processed data with a number of different sets of operating window data appropriate for coins of different denominations so that the coin acceptor can accept or reject more than one coin of a particular currency set. If the coin is accepted, its passage along the accept path 6 is detected by the post acceptance credit sensor coil unit PS, and the unit 10 passes corresponding data to the microcontroller 11, which in turn provides an output on line 15 that indicates the amount of monetary credit attributed to the accepted coin.

The sensor coil units S each include one or more inductor coils connected in an individual oscillatory circuit and the coil drive and interface circuit 10 includes a multiplexer to scan outputs from the coil units sequentially, so as to provide data to the microcontroller 11. Each circuit typically oscillates at a frequency in a range of 50–150 kHz and the circuit components are selected so that each sensor coil S1–S4 has a different natural resonant frequency in order to avoid cross-coupling between them.

As the coin passes the sensor coil unit S1, its impedance is altered by the presence of the coin over a period of ~100 milliseconds. As a result, the amplitude of the oscillations through the coil is modified over the period that the coin passes and also the oscillation frequency is altered. The variation in amplitude and frequency resulting from the modulation produced by the coin is used to produce the coin parameter signals $x_1$–$x_4$ representative of characteristics of the coin.

Processing Circuitry

Figure 3:
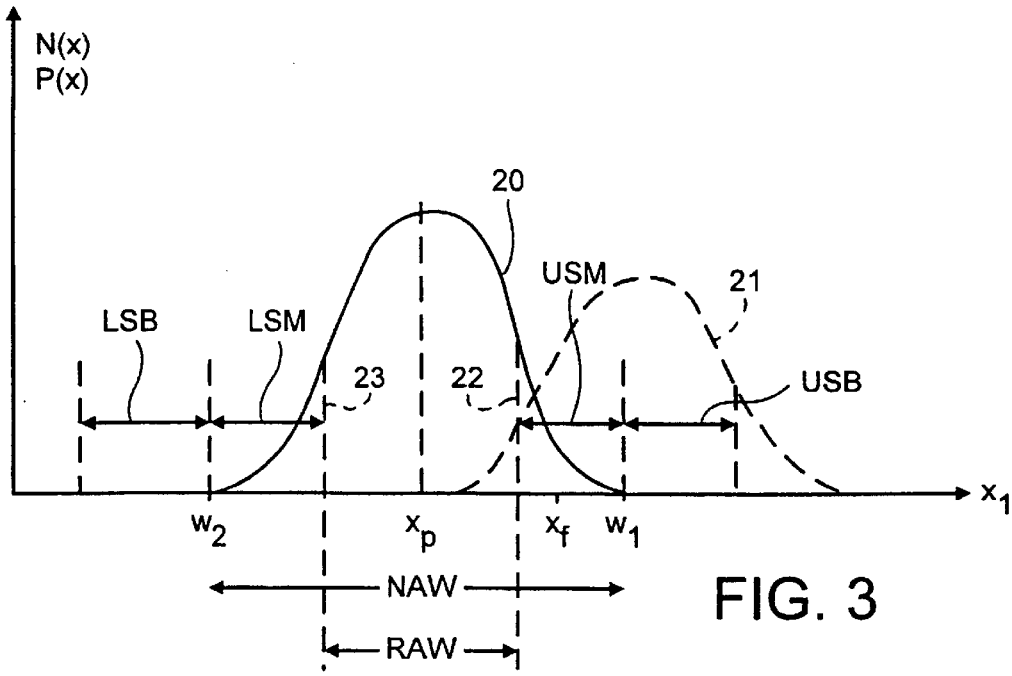
FIG. 3 is a distribution curve of coin parameter signals produced by the acceptor of FIG. 1.

FIG. 3 illustrates a bell shaped distribution curve 20 of the values of one of the parameters, $x_1$, produced when a number of coins of the same denomination are passed through the validator. It can be seen that most of the occurrences of the parameter value $x_1$ occur at a peak value $x_p$ and a generally bell shaped distribution occurs around this peak value. The distribution can be determined by passing a number e.g. 100 coins of the same denomination through the validator and recording the corresponding values of $x_1$. The EEPROM 12 stores data corresponding to a window of acceptable values of the parameter $x_1$ for each denomination of coin to be accepted by the validator. In FIG. 3, one of the windows, referred to herein as a normal acceptance window NAW, is shown, extending between upper and lower window limit values $w_1$, $w_2$. The stored data in EEPROM 12 may comprise the upper and lower window limit values $w_1$, $w_2$ themselves or may comprise a mean value and a standard deviation, such that the microcontroller 11 can define the window NAW from the stored data as a predetermined number of standard deviations about the mean.

The graph of FIG. 3 can also be considered in a different way. For coins of the true denomination that corresponds to the normal acceptance window (NAW), the most likely value of parameter $x_1$ is the peak value $x_p$ and the least likely value occurs at the upper and lower window limits $w_1$, $w_2$. Whilst it is possible for an acceptable value $x_f$ to occur close to one of the window limits $w_1$, the probability distribution shown in FIG. 3 makes clear that it is unlikely that many such values $x_f$ will occur for the true coin concerned. If several values $x_f$ occur, this is more likely to indicate the presence of a fraudulent distribution as shown in dotted outline, with a peak value centered on or around $x_f$. This property is used in accordance with the invention to discriminate between true coins and a set of frauds that have been manufactured to the same design which produce coin parameter values $x_f$ lying within the normal acceptance window NAW. In accordance with the invention, the occurrence of more than parameter value $x_f$ is considered to be unusual and likely to represent the occurrence of a fraud. In accordance with the invention, a restricted access window RAW shown in FIG. 3 is used detection of such a situation, as will now be described.

As shown in FIG. 3, upper and lower safety margins LSM, USM are defined in regions of relatively low probability of an occurrence of a parameter value corresponding to a true coin. It will be understood from the distribution curve 20 that it is much more likely for an occurrence of parameter signal $x_1$ to occur between the area of relatively high probability between dotted lines 22, 23 than in the lower and upper safety margins LSM, USM, where there is a relatively low probability of occurrence of a true value. In accordance with the invention, when the microcontroller 11 shown in FIG. 2 detects the presence of a value $x_f$ in either the LSM or USM, it then changes from the normal acceptance window NAW to a restricted acceptance window RAW based on data stored in EEPROM 12, which is narrower than the normal acceptance window, as shown in FIG. 3. In practice, the RAW may correspond to the region of high probability between the dotted lines 22, 23 although different values can be used, which are non-contiguous with the LSM and USM.

If the next, subsequent occurrence of the parameter signal $x_1$ produced by the next coin under test, occurs in e.g. the USM, close to the previous value $x_f$, the next coin will be rejected because it lies outside of the restricted access window RAW and is more likely to indicate the presence of a fraudulent coin forming part of the fraudulent coin distribution 21 than the true coin forming part of the distribution 20.

When a first coin under test exhibits a parameter signal $x_f$ within either the upper or lower safety margin, USM, LSM of the normal acceptance window NAW, the coin is accepted as a true coin (assuming that its other detected parameters are satisfactory) but the acceptor then switches to a restricted access window RAW for subsequent coins. The occurrence of the first coin with parameter value $x_f$ sets a flag which may comprise a counter in the microcontroller 11. The acceptor continues to use the restricted access window for a predetermined number of coins set by the counter, and the flag remains set until a number of coins with parameter signals $x_1$ lying within the restricted window RAW occur in succession. The number is dependent upon the distribution of coin data and the probability of a true coin legitimately falling at the limits of the distribution 20. This will vary from coin to coin but typically might be six or eight insertions of coin or could be as few as one or as many as twenty.

If another coin produces a value $x_1$ outside of the restricted access window prior to expiry of the count, the flag is reset and the count begins again.

Additionally, an upper security barrier USB and a lower security barrier LSB are disposed above and below the upper and lower window limits $w_1$, $w_2$ respectively. If a coin produces a parameter signal $x_1$ lying within either the upper or lower security barrier regions USB, LSB, the previously described process is carried out and the acceptor switches from the normal acceptance window NAW to the restricted access window RAW. This process is carried out in order to reject potentially fraudulent coins that form part of a distribution such as the fraudulent distribution 21. For example, it may be possible to find a coin of a foreign denomination which has a close, similar distribution to the true distribution 20, the foreign coin having a distribution 21. The fraudster may attempt to defraud the validator by feeding a series of the foreign coins of the same denomination through the acceptor. With the described arrangement according to the invention, the first foreign coin would be rejected if its parameter signal fell within USB because it is outside of the normal acceptance range NAW, and would cause the system to switch to the RAW to reject subsequent coins of the fraudulent coin distribution. If the first fraudulent coin's parameter signal fell within USM, it would be accepted and again would cause the system to switch from NAW to RAW for subsequent coins. Since for most of the fraudulent foreign coins, their parameter signal is more likely to be in USB than other parts of the distribution 21, there is a high probability that the first fraudulent coin will be rejected.

The acceptor may also include a timer which, after the restricted access window RAW has been adopted, returns the acceptor back to the normal acceptance window NAW after a given time period. The fraudster may insert a fraudulent coin, get it accepted by the coin acceptor which then switches to use of the restricted access window RAW. If the fraudster then gives up after a few more tries, and goes away, the timer can then time-out in time for an honest user to come and use the acceptor on the basis of the normal acceptance window.

Figure 4:
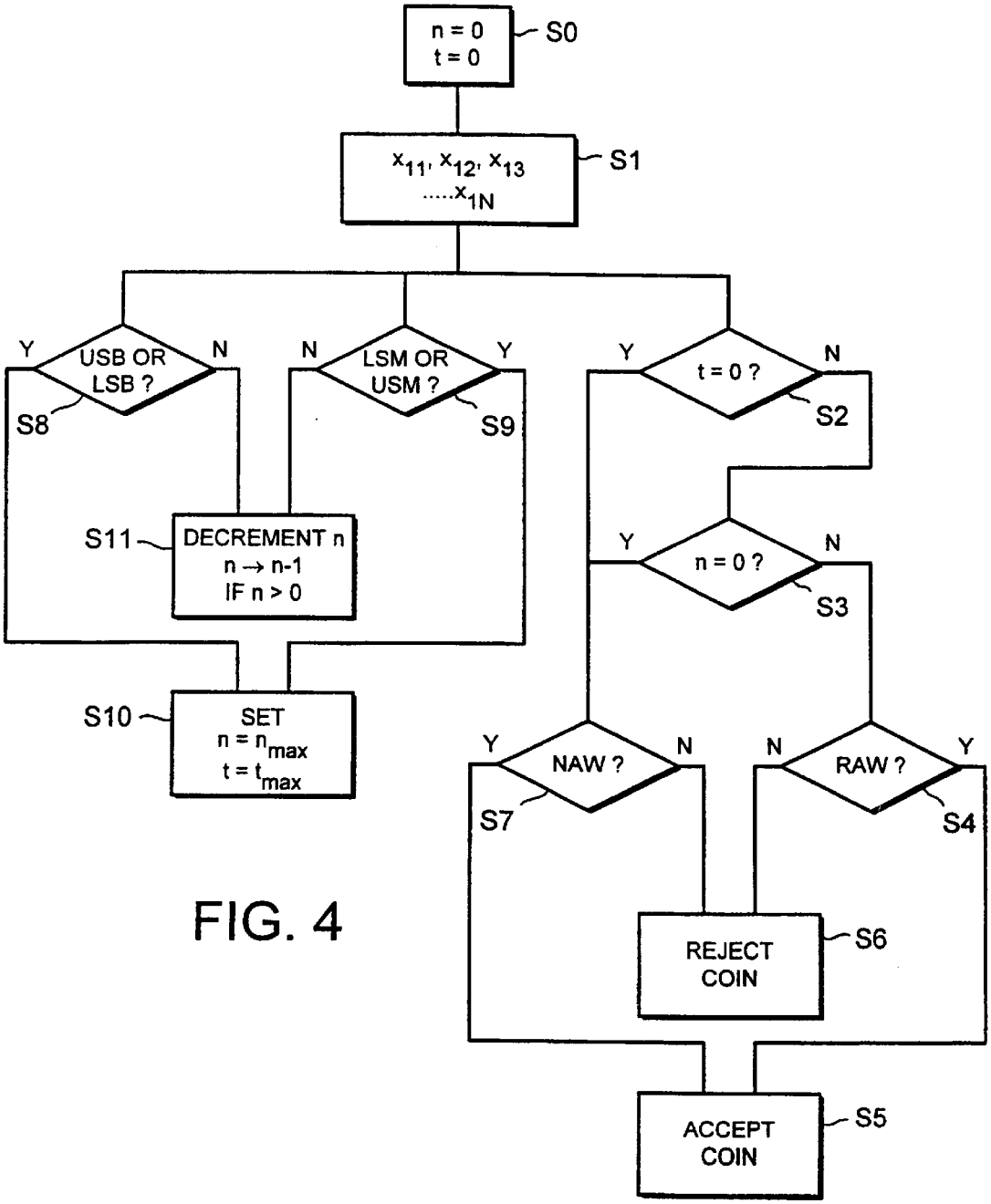
FIG. 4 is a schematic flow diagram of processing steps carried out by the microcontroller 11.

The routine followed by the microcontroller 11 is shown in more detail in FIG. 4. At step SO, the system is initialised. The aforementioned counter is set so that its operating parameter n is initialised i.e. n=0. Also, the aforementioned timer has an operating parameter t which can vary from $t_{max}$ to zero, which indicates a timed-out condition at step SO t is initialised i.e. t=0.

At step S1, successive values of the parameter signal $x_{1\ 1}$, $x_{1\ 2}$, . . . $x_{1N}$ are shown. These occurrences of the parameter signal are produced in response to the acceptor testing successive coins one after the other. The successive occurrences of the parameter signal are tested one after the other by the remainder of the routine as will now be explained.

Considering the first occurrence of the parameter signal $x_{1\ 1}$, produced in response to a first coin, at step S2, a test is carried out to see if the timer is active. If it is not active, t=0. This means that a sufficiently long period of time has elapsed since the acceptor was last used, indicating that it is safe to use the relatively wide, normal acceptance window NAW.

At step S3, the status of the flag counter is checked. If the flag parameter n=0, this means that the flag is not set and that it is safe to use the normal acceptance window NAW. However, if the flag counter is set whilst the timer is running, it is not safe to use the normal acceptance window because the conditions indicate that a previously accepted coin has triggered the flag counter whilst the timer is running. As a result, the value of $x_{1\ 1}$ needs to be compared with the restricted access window RAW. This is carried out at step S4. If the value of $x_{1\ 1}$ falls within the restricted access window RAW, the coin is accepted at step S5 but otherwise is rejected at step S6.

As previously mentioned, if the timer or the counter flag are set to 0, it is safe to use the normal acceptance window NAW. This test is carried out at step S7 and the coin is either accepted or rejected at step S5 or S6.

In addition to comparing the parameter value against either of the acceptance windows, each occurrence of the parameter value is compared with the upper and lower safety margins and safety barriers. These tests are performed at steps S8 and S9. If the parameter value signal $x_{1\ 1}$ falls within any of the barriers or margins USB, USM, LSB, LSM, this indicates that the aforementioned flag needs to be set and that the timer t should be set running. These activities are carried out at step S10, at which the count parameter n is set to a predetermined maximum value $n_{max}$. It will be understood that $n_{max}$ and an integer number corresponding to the successive number of coins which subsequently need to be found to be true when using the relatively narrow restricted access window RAW. The value of the timer interval t is set to $t_{max}$ which corresponds to the period of time for which the timer will run until reaching a value t=0. This, therefore sets the time after which the acceptor will recover and switch back to use the normal acceptance window NAW after a period of using the restricted access window RAW (step S2).

If the value of the parameter signal $x_{1\ 1}$ does not fall within any of the margins or barriers tested by step S8, S9, this indicates that the parameter signal $x_{1\ 1}$, on the assumption that the coin has been accepted, falls within the restricted access window RAW. In this situation, the counter parameter n needs to be decremented, if it is not already zero. This occurs at step S11.

Considering the situation where the first occurrence of the coin parameter signal $x_{1\ 1}$ falls within the upper safety margin USM. In this situation, t=0 and n=0 so that the routine passes to step S7 at which the value is compared with the normal acceptance window NAW. The value of $x_{1\ 1}$ falls within the window and hence the coin is accepted at step S5.

Additionally, the value of $x_{1\ 1}$ is found to be within the upper safety margin USM, at step S9. As a result, the flag counter parameter n is set to $n_{max}$ and the timer parameter t is set to $t_{max}$ at step S10.

When a second coin is entered a second occurrence of the coin parameter signal $x_1$ is produced, namely $x_{1\ 2}$. At step S2, the timer is now set to t≠0 and so the process moves to step S3. The parameter n≠0 and so the value of $x_{1\ 2}$ is compared with the restricted access window RAW at step S4. The value is either accepted or rejected. Assuming it is accepted, and falls outside of the margins and barriers tested at step S8 and S9, the counter parameter n is decremented at step S11. The timer t is running all the time towards zero.

The process continues with the subsequent occurrences of the parameter $x_1$ until is the timer t=0 or the counter flag n=0. The acceptor then reverts to the use of the normal acceptance window NAW.

The previously described process thus relates to one of the coin parameter signals $x_1$. However, as previously explained, four different coin parameter signals $x_1$–$x_4$ are produced in this example and in fact, in practice, up to fourteen different individual parameter signals may be processed. The routine performed according to FIG. 4 may be carried out for each individual coin parameter signal with each having its own normal access window and restricted access window, controlled as previously described, with each parameter signal being processed independently of the others. Alternatively, to simplify the processing, the occurrence of one parameter signal falling within its respective USB, LSB, LSM or USM may trigger the use of an individual restricted access window for all of the coin parameter signals concurrently.

Other modifications are possible. In the routine shown in FIG. 3, the counter flag is clocked downwardly from a first predetermined number $n_{max}$. Typically $n_{max}$ is in a range of 6 to 20 inclusive. Whilst n≠0 the restricted access window RAW is used (step S3). However, when n=0 i.e. when 6 to 20 true coins have been detected, the normal window NAW is used. The occurrence of a single fraudulent coin will then re-trigger the use of the RAW (steps S8–S10). However, if desired a different pre-selected number p of occurrences of fraudulent coin could be used to re-set $n=n_{max}$ and thereby re-trigger the use of the RAW. The pre-selected number p of occurrences of fraudulent coin is selected to be less than the predetermined number n to thereby improve the sensitivity of the system. Preferably the number p is 1 as described with reference to FIG. 4 to maximise the sensitivity to fraudulent coins, although a larger value of p may in some instances be desirable to provide system damping.

In another modification, the routine may switch from the normal acceptance window NAW to the RAW in response to a coin parameter signal falling within a very narrow portion of the NAW itself, which may signify a fraudulent coin in certain circumstances.

Banknote Acceptor

Figure 5:
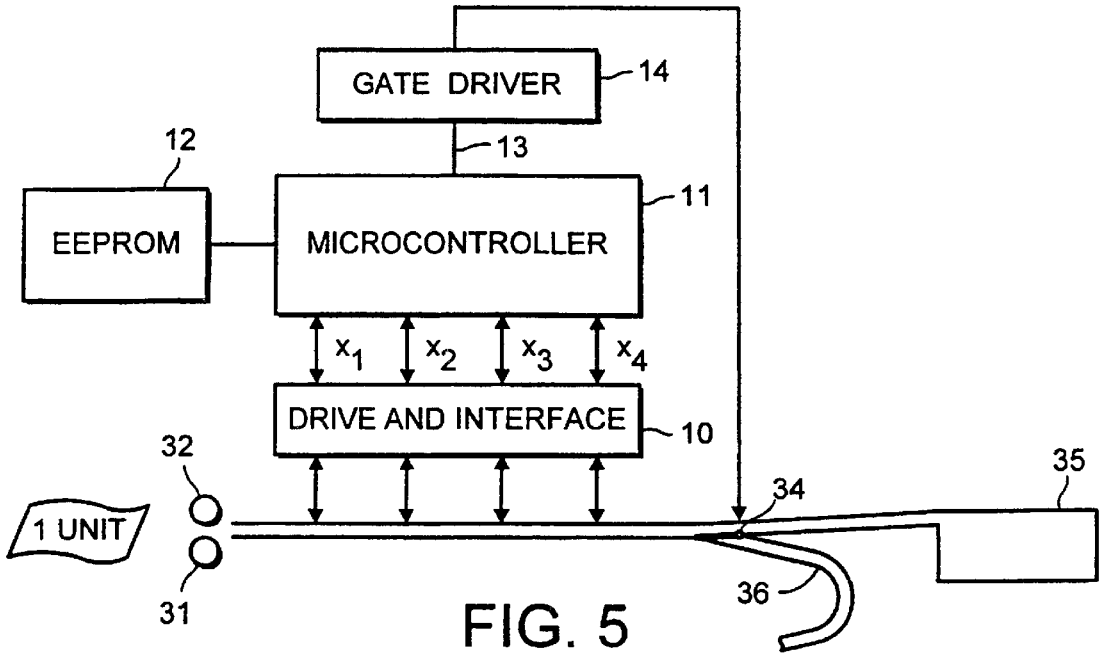
FIG. 5 is a schematic diagram of a banknote acceptor in accordance with the invention.

The previously described routine is also applicable to banknote acceptors and an example is shown in FIG. 5. A banknote 30 to be tested is inserted between driven rollers 31, 32 so as to pass over a sensing platen 33 over which a series of banknote sensors are disposed. In this example, four sensors S1, S2, S3 and S4 are shown schematically. The sensors may include optical sensors for sensing the length, width or thickness of the banknote, sensors for detecting reflected light from the banknote in order to analyse the spectral response. Alternatively, the light may be sensed in transmission through the banknote. One or more individual predetermined parts of the banknote may be measured. Also, the presence of magnetic printing ink may be detected as described in U.S. Pat. No. 4,864,238. The sensors S1–S4 are driven and processed by drive and interface circuitry 10 to produce individual parameter signals $x_1$, $x_2$, $x_3$, $x_4$. These parameter signals are similar to the corresponding signals described with reference to FIGS. 1 and 2 for the coin acceptor although indicative of different parameters relating to a banknote. The resulting signals thus can be processed according to the previously described routine. The parameter signals are passed to a microcontroller 11 connected to an EEPROM 12 that contains stored window values. The parameter signals are compared with stored windows corresponding to acceptable banknotes in the manner previously described with reference to FIG. 4 and upon detection of an acceptable banknote, an output is provided on line 13 to a gate driver 14 which operates a gate 34. If the banknote is found to be acceptable, it is passed to a store 35 but otherwise is fed into a reject path 36 and passes out of the acceptor.

Thus, in accordance with the invention, the banknote acceptor is provided with increased security to discriminate against a fraudster inserting a series of fraudulent banknotes all made according to the same design, which individually would fall within the normal acceptance window for an acceptable denomination of banknote.

Whilst the invention has been described by way of example in relation to a coin acceptor and a bank note acceptor it will be understood that it is applicable to other money items such as tokens which are sometimes used instead of coins and other sheet members which have an attributable money value including, but not limited to, credit and debit cards.

What is claimed is:

1. A money item acceptor comprising:

a signal source to produce a money item parameter signal as a function of a sensed characteristic of a money item, a store to provide data corresponding to a normal acceptance range of values of the parameter signal for a money item of a particular denomination, the range including relatively high and low acceptance probability regions wherein the value of a parameter signal corresponds to a relatively high or low probability of an occurrence of sensed money item of said particular denomination, and a processor to determine when an occurrence of a parameter signal corresponding to a first money item adopts a predetermined value relationship, and in response thereto, to compare the value of a subsequent occurrence of a parameter signal corresponding to a second money item with data corresponding to a restricted acceptance range as compared with the normal acceptance range, and to provide an output corresponding to acceptability of the second money item if the second occurrence of the parameter signal falls within the restricted acceptance range, wherein said predetermined value relationship occurs when the parameter signal corresponding to the first money item has a value within a predetermined security barrier range outside of the normal acceptance range.

2. An acceptor according to claim 1 wherein said predetermined value relationship occurs when the parameter signal corresponding to the first money item has a value within one of (a) the low probability region and (b) the predetermined security barrier range outside of the normal acceptance range.

3. An acceptor according to claim 2, wherein the restricted acceptance range corresponds to the high probability region.

4. An acceptor according to claim 1 wherein said predetermined value relationship occurs when the parameter signal corresponding to the first money item has a value within one of (a) the low probability region and (b) the predetermined security barrier range outside of the normal acceptance range and (c) a predetermined portion of said high acceptance probability region.

5. An acceptor according to claim 4 wherein the restricted acceptance range corresponds to the high probability region.

6. An acceptor according to claim 1, wherein the restricted acceptance range corresponds to the high probability region.

7. An acceptor according to claim 1, wherein the processor is operable to compare a predetermined number of subsequent occurrences of the parameter signal with said restricted acceptance range, and if said predetermined number all correspond to acceptable money items, thereafter to revert to the normal acceptance range.

8. An acceptor according to claim 7 wherein the processor is operable to compare the parameter signal with the normal acceptance range and to switch to the restricted range following a pre-selected number of occurrences of the parameter signal falling in said low acceptance probability region, said pre-selected number being less than said predetermined number.

9. An acceptor according to claim 8 wherein the pre-selected number is one and the predetermined number is between six and twenty inclusive.

10. An acceptor according to claim 1, wherein the processor is operable to compare any subsequent occurrences of the parameter signal with said restricted acceptance range for a predetermined time and then to revert to the normal acceptance range.

11. An acceptor according to claim 1, wherein the signal source is operable to produce a plurality of individual money item parameter signals each as a function of a respective different characteristic of a sensed money item, and the store is configured to provide data for normal acceptance ranges of values of the parameter signals individually for a money item of a particular denomination.

12. An acceptor according to claim 11 wherein the processor is operable to compare the first occurrence of each parameter signal individually with a corresponding one of said normal acceptance ranges, and to compare a subsequent occurrence of each of the different parameter signals with a corresponding restricted acceptance range for each parameter signal, in response to any one of the first occurrences of the parameter signals having a predetermined value relationship with the low acceptance probability region of its corresponding normal acceptance range.

13. An acceptor according to claim 11 wherein the processor is operative to compare the first occurrence of each parameter signal individually with a corresponding one of said normal acceptance ranges, and to compare a subsequent occurrence of each of the different parameter signals with a corresponding restricted acceptance range for each parameter signal, selectively in response to a corresponding one of the first occurrences of the parameter signal shaving a predetermined value relationship with the low acceptance probability region of its normal acceptance range.

14. An acceptor according to claim 11, wherein the signal source includes a sensor to sense a characteristic of the money item.

15. An acceptor according to claim 14 wherein the sensor is operable to sense a characteristic of a money item that comprises a coin.

16. An acceptor according to claim 15 wherein the sensor comprises an inductor to sense an inductive characteristic of the coin.

17. An acceptor according to claim 15 wherein the sensor is operable to sense a characteristic of a money item that comprises a banknote.

18. An acceptor according to claim 1 including a timer operable to time a predetermined period in response to an occurrence of a parameter signal corresponding to a money item adopting said predetermined value relationship, the processor being operable to compare a subsequent occurrence of a parameter signal with the restricted acceptance range until the timer times out and then to revert to the normal acceptance range.

19. A method of accepting a money item comprising:

producing a money item parameter signal as a function of a sensed characteristic of a money item, providing data corresponding to a normal acceptance range of values of the parameter signal for a money item of a particular denomination, the range including relatively high and low acceptance probability regions wherein the value of a parameter signal corresponds to a relatively high or low probability of an occurrence of sensed money item of said particular denomination, determining when an occurrence of the parameter signal corresponding to a first money item has a value within a predetermined security barrier range outside of the normal acceptance range, and in response thereto, comparing the value of a subsequent occurrence of the parameter signal corresponding to a second money item with data corresponding to a restricted acceptance range as compared with the normal acceptance range, and providing an output corresponding to acceptability of the second money item if the second occurrence of the parameter signal falls in the restricted acceptance range.

20. A money acceptor comprising:

a signal source to produce a money item parameter signal as a function of a sensed characteristic of a money item, a store to provide data corresponding to a normal acceptance range of values of the parameter signal for a money item of a particular denomination, the range including relatively high and low acceptance probability regions wherein a value of a parameter signal corresponds to a relatively high or low probability of an occurrence of sensed money item of said particular denomination, and a processor to determine when an occurrence of the parameter signal corresponding to a first money item adopts a predetermined value relationship with the low acceptance probability region, and in response thereto, to compare the value of a subsequent occurrence of a parameter signal corresponding to a second money item with data corresponding to a restricted acceptance range as compared with the normal acceptance range, and to provide an output corresponding to acceptability of the second money item if the second occurrence of the parameter signal falls in the restricted acceptance range, and if all of a first predetermined number of the subsequent occurrences correspond to acceptable money items, to revert to the normal acceptance range, wherein when using the normal acceptance range, the restricted acceptance range is selected in response to a second pre-selected number of occurrences of the parameter signal, smaller than said first predetermined number, adopting said predetermined value relationship.

21. An acceptor according to claim 20 wherein said second pre-selected number of occurrences comprises a single occurrence.

22. An acceptor according to claim 21 wherein the first predetermined number of occurrences is between six and twenty inclusive.

23. An acceptor according to claim 22 wherein the first predetermined number of occurrences is between six and eight inclusive.

24. An acceptor according to claim 22 wherein the processor is operable to compare occurrences of the parameter signal subsequent to the adoption of the restricted acceptance range, with said restricted acceptance range for a predetermined item and then to revert to the normal acceptance range.

25. An acceptor according to claim 20 wherein the processor is operable to compare occurrences of the parameter signal subsequent to the adoption of the restricted acceptance range, with said restricted acceptance range for a predetermined item and then to revert to the normal acceptance range.

26. An acceptor according to claim 25 wherein said predetermined value relationship occurs when the parameter signal corresponding to the first money item has a value within the low acceptance probability region.

27. An acceptor according to claim 20 wherein said predetermined value relationship occurs when the parameter signal corresponding to the first money item has a value within the low acceptance probability region.

28. An acceptor according to claim 27 wherein said predetermined value relationship occurs when the parameter signal corresponding to the first money item has a value within a predetermined security barrier range outside of the normal acceptance range.

29. An acceptor according to claim 20 wherein said predetermined value relationship occurs when the parameter signal corresponding to the first money item has a value within a predetermined security barrier range outside of the normal acceptance range.

30. An acceptor according to claim 29 wherein said predetermined value relationship occurs when the parameter signal corresponding to the first money item has a value within a predetermined portion of said high acceptance probability region.

31. An acceptor according to claim 20 wherein said predetermined value relationship occurs when the parameter signal corresponding to the first money item has a value within a predetermined portion of said high acceptance probability region.

32. An acceptor according to claim 20 including a timer operable to time a predetermined period in response to an occurrence of a parameter signal corresponding to a money item adopting said predetermined value relationship, the processor being operable to compare a subsequent occurrence of a parameter signal with the restricted acceptance range until the timer times out and then to revert to the normal acceptance range.

33. A method of accepting a money item comprising:

producing a money item parameter signal as a function of a sensed characteristic of a money item, providing data corresponding to a normal acceptance range of values of the parameter signal for a money item of a particular denomination, the range including relatively high and low acceptance probability regions wherein a value of a parameter signal corresponds to a relatively high or low probability of an occurrence of sensed money item of said particular denomination, determining when an occurrence of the parameter signal corresponding to a first money item adopts a predetermined value relationship with the low acceptance probability region, and in response thereto, comparing the value of a subsequent occurrence of the parameter signal corresponding to a second money item with data corresponding to a restricted acceptance range as compared with the normal acceptance range, and providing an output corresponding to acceptability of the second money item if the second occurrence of the parameter signal falls in the restricted acceptance range, comparing a first predetermined number of subsequent occurrences of the parameter signal within the restricted acceptance range, and if the subsequent occurrences correspond to acceptable money items, reverting to the normal acceptance range, wherein when using the normal acceptance range, the restricted acceptance range is selected when a second pre-selected number of occurrences of the parameter signal, smaller than said first predetermined number, adopt said predetermined value relationship.

* * * * *